US010537909B2

(12) United States Patent
Popovici et al.

(10) Patent No.: US 10,537,909 B2
(45) Date of Patent: Jan. 21, 2020

(54) POWDER COATING APPARATUS

(71) Applicant: NITTO DENKO CORPORATION, Ibaraki-shi, Osaka (JP)

(72) Inventors: Daniel Popovici, Osaka (JP); Keita Mine, Osaka (JP); Shusaku Shibata, Osaka (JP); Toshitaka Nakamura, Osaka (JP)

(73) Assignee: NITTO DENKO CORPORATION, Ibaraki-shi, Osaka (JP)

( * ) Notice: Subject to any disclaimer, the term of this patent is extended or adjusted under 35 U.S.C. 154(b) by 0 days.

(21) Appl. No.: 15/326,108

(22) PCT Filed: Jun. 3, 2015

(86) PCT No.: PCT/JP2015/066098
§ 371 (c)(1),
(2) Date: Jan. 13, 2017

(87) PCT Pub. No.: WO2016/031336
PCT Pub. Date: Mar. 3, 2016

(65) Prior Publication Data

US 2017/0209886 A1 Jul. 27, 2017

(30) Foreign Application Priority Data

Aug. 29, 2014 (JP) ..... 2014-176264

(51) Int. Cl.
*B05B 13/02* (2006.01)
*B05B 14/00* (2018.01)
(Continued)

(52) U.S. Cl.
CPC ..... *B05B 13/0207* (2013.01); *B05B 7/1445* (2013.01); *B05B 7/1463* (2013.01);
(Continued)

(58) Field of Classification Search
None
See application file for complete search history.

(56) References Cited

U.S. PATENT DOCUMENTS 6,197,368 B1 * 3/2001 Valenti ..... B05C 13/02 118/308
6,705,245 B1 * 3/2004 Jeong ..... B05D 1/62 118/715
(Continued)

FOREIGN PATENT DOCUMENTS

CN 1370329 A 9/2002
DE 10 2010 031 741 A1 1/2012
(Continued)

OTHER PUBLICATIONS

International Search Report of PCT/JP2015/066098 dated Sep. 8, 2015.
(Continued)

*Primary Examiner* — Charles Capozzi
(74) *Attorney, Agent, or Firm* — Sughrue Mion, PLLC

(57) ABSTRACT

A powder coating apparatus for attaching powder to a film includes a forwarding roll which forwards the film; a take-up roll which is arranged on the downstream side of a conveyance direction of the film with respect to the forwarding roll and which takes up the film; a film-forming nozzle which is arranged between the forwarding roll and the take-up roll in the conveyance direction so as to be opposed to the film and which jets the powder; a first casing or a second casing which accommodates the forwarding roll and the take-up roll; an apparatus casing which accommodates the film-forming nozzle, the first casing, and the second casing; and a pressure adjustment unit configured to set an internal pressure of the first casing and the second casing to be higher than an internal pressure of the apparatus casing.

4 Claims, 4 Drawing Sheets

(51) Int. Cl.

| | |
|---|---|
| ***B05D 7/04*** | (2006.01) |
| ***B05D 1/12*** | (2006.01) |
| ***C23C 24/04*** | (2006.01) |
| ***C23C 4/14*** | (2016.01) |
| ***C23C 4/137*** | (2016.01) |
| ***B05B 7/14*** | (2006.01) |
| ***B05B 7/24*** | (2006.01) |
| ***B05D 7/14*** | (2006.01) |

(52) U.S. Cl.

CPC ..... *B05B 7/2491* (2013.01); *B05B 14/00* (2018.02); *B05D 1/12* (2013.01); *B05D 7/04* (2013.01); *B05D 7/14* (2013.01); *C23C 4/137* (2016.01); *C23C 4/14* (2013.01); *C23C 24/04* (2013.01)

(56) References Cited

U.S. PATENT DOCUMENTS

2003/0047133 A1* 3/2003 Lim ..... C23C 16/482 118/50.1
2008/0041301 A1* 2/2008 Hein ..... C23C 14/562 118/44
2011/0104369 A1* 5/2011 Kim ..... C23C 24/04 427/180
2013/0123112 A1* 5/2013 Arndt ..... H01L 39/2487 505/470
2013/0149471 A1 6/2013 Kim

FOREIGN PATENT DOCUMENTS

| | | | |
|---|---|---|---|
| EP | 2 674 990 | A2 | 12/2013 |
| JP | 2003-508626 | A | 3/2003 |
| JP | 2004-300572 | A | 10/2004 |
| JP | 2010-236057 | A | 10/2010 |
| JP | 2013-129887 | A | 7/2013 |
| KR | 10-2010-0031163 | A | 3/2010 |

OTHER PUBLICATIONS

Extended European Search Report dated Feb. 8, 2018, issued by EPO in corresponding Application No. 15835215.3.
Notification of Reasons for Refusal dated Mar. 29, 2018, issued by the Japanese Patent Office in counterpart JP Application No. 2014-176264.
Notification of First Office Action dated Jul. 26, 2018 from the State Intellectual Property Office of the P.R.C. in counterpart Application No. 201580031961.1.
Notification of Second Office action dated Jan. 24, 2019 from the State Intellectual Property Office of the P.R.C. in counterpart Application No. 201580031961.1.

* cited by examiner

POWDER COATING APPARATUS

CROSS REFERENCE TO RELATED APPLICATIONS

This is a National Stage of International Application No. PCT/JP2015/066098 filed Jun. 3, 2015, claiming priority based on Japanese Patent Application No. 2014-176264 filed Aug. 29, 2014, the contents of all of which are incorporated herein by reference in their entirety.

TECHNICAL FIELD

The present invention relates to a powder coating apparatus, in particular, to a powder coating apparatus for attaching powder to a film.

BACKGROUND ART

Conventionally, for the method for attaching powder to a substrate such as a film, various methods such as spraying have been proposed.

Of these methods, in view of allowing fine layer formation on the substrate, aerosol deposition method is particularly gaining attention.

For example, Patent Document 1 has proposed an apparatus used for aerosol deposition method.

The apparatus disclosed in Patent Document 1 includes a film-forming chamber having a space for attaching powder to a substrate therein, an aerosol chamber that stores a powder material, and a carrier gas transportation device, and the film-forming chamber that accommodates a pedestal for disposing and fixing the substrate, and a nozzle that sprays powder to the substrate therein.

CITATION LIST

Patent Document

Patent Document 1: Japanese Unexamined Patent Publication No. 2013-129887

SUMMARY OF THE INVENTION

Problem to be Solved by the Invention

However, the apparatus of Patent Document 1 operates by batch. That is, with the apparatus of Patent Document 1, the substrate has to be put in and out from the film-forming chamber every time the coating is performed on one substrate, and production efficiency is poor. Therefore, an apparatus which uses continuous process is demanded.

For the continuous system, use of a roll to roll system has been examined. To be specific, a method such as the following has been examined: a pair of rolls is disposed inside the film-forming chamber, and the powder is attached to the substrate while the substrate is taken up from one roll to the other roll continuously.

Meanwhile, in the method in which powder is sprayed on the substrate, the powder jetted from the spray nozzle to the substrate partially scatters inside the air, that is, inside the film-forming chamber without being attached to the substrate. The scattered powder is, when stored inside the film-forming chamber, attached to the roll and coated substrate. This causes disadvantages such as malfunctioning of the roll to roll device and poor quality of the coated substrate.

An object of the present invention is to provide a continuous powder coating apparatus that enables reduction of effects from the scattered powder.

Means for Solving the Problem

A powder coating apparatus of the present invention is a powder coating apparatus for attaching powder to a film, and includes a forwarding roll which forwards the film; a take-up roll which is arranged on the downstream side of a conveyance direction of the film with respect to the forwarding roll and which takes up the film; a nozzle which is arranged between the forwarding roll and the take-up roll in the conveyance direction so as to be opposed to the film and which jets the powder; one, or two or more roll chambers which accommodate the forwarding roll and the take-up roll; an apparatus chamber which accommodates the nozzle and the roll chamber; and a pressure adjustment unit configured to set an internal pressure of the roll chamber to be higher than an internal pressure of the apparatus chamber.

With the powder coating apparatus, the pressure adjustment unit sets the internal pressure of the roll chamber to be higher than the internal pressure of the apparatus chamber, and therefore entrance of the powder scattered inside a relatively low pressure apparatus chamber into a relatively a high pressure roll chamber can be suppressed. Therefore, attachment of powder to the roll and the coated film can be prevented, and the effects from the powder can be reduced.

It is preferable that the powder coating apparatus of the present invention includes two roll chambers, wherein one of the roll chambers accommodates the forwarding roll and the other of the roll chambers accommodates the take-up roll.

With the powder coating apparatus, the forwarding roll and the take-up roll are individually accommodated in the roll chamber, and therefore relative position and distance between the forwarding roll and the take-up roll can be freely adjusted. Therefore, the apparatus can be freely designed.

It is preferable that the powder coating apparatus of the present invention includes one roll chamber, wherein the one roll chamber accommodates the forwarding roll and the take-up roll.

With the powder coating apparatus, the internal pressure of the only one roll chamber is set higher than the internal pressure of the apparatus chamber, and therefore the apparatus can be made simple.

In the powder coating apparatus of the present invention, it is preferable that the pressure adjustment unit comprises a gas feeding device which feeds gas into the roll chamber.

With the powder coating apparatus, the internal pressure of the roll chamber can be set higher than the internal pressure of the apparatus chamber simply and reliably.

It is preferable that the powder coating apparatus of the present invention further includes a powder removal device which is arranged between the downstream side of the nozzle and the upstream side of the take-up roll in the conveyance direction so as to be opposed to the film and which removes an excess of powder attached to the film.

With the powder coating apparatus, extra powder attached to the film can be removed, and therefore a level of the coated film quality can be kept.

Effects of the Invention

With the powder coating apparatus of the present invention, effects of the powder scattered inside the film-forming chamber to the apparatus can be reduced.

DESCRIPTION OF EMBODIMENTS

1. First Embodiment

1-1. Powder Coating Apparatus

A first embodiment of the powder coating apparatus of the present invention is described with reference to FIG. 1.

Figure 1:
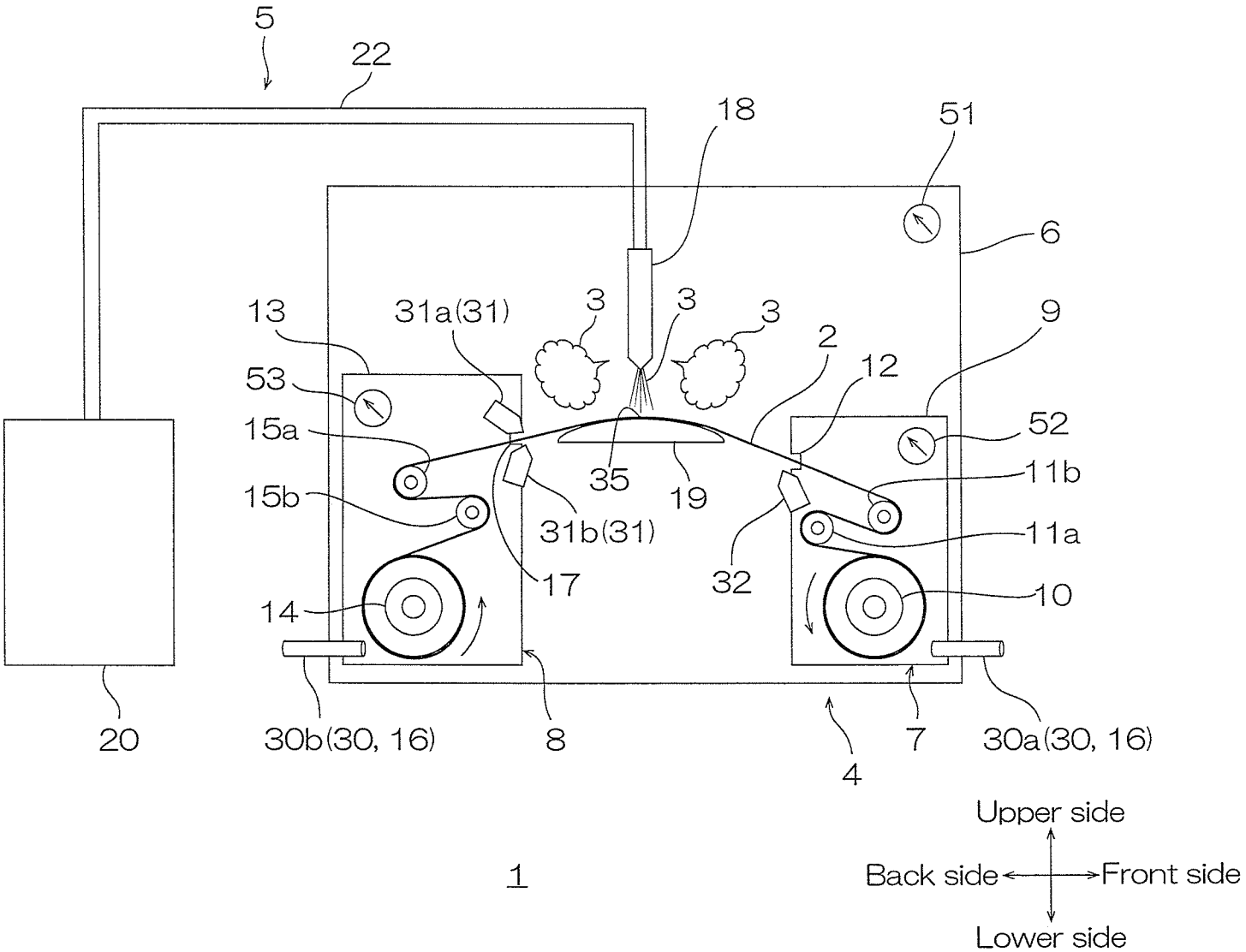
FIG. 1 shows a diagram illustrating the configuration of a first embodiment of the powder coating apparatus of the present invention.
Figure 4:
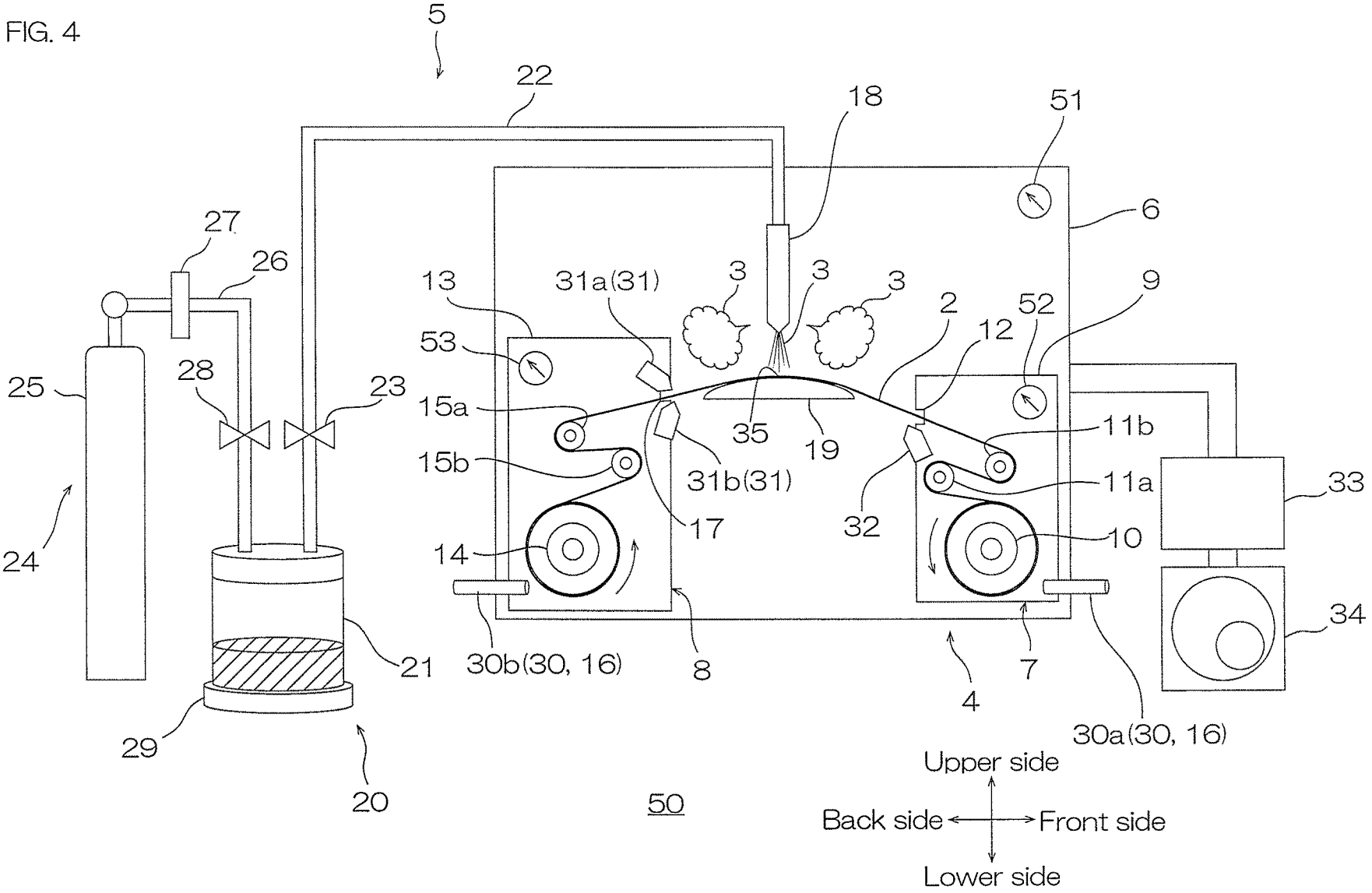
FIG. 4 shows a diagram illustrating the configuration of a powder coating apparatus where aerosol deposition method is used in the first embodiment.

In the description with reference to FIG. 1, when referring to directions of the powder coating apparatus, the up-down directions on paper surface of FIG. 1 is referred to as "up-down directions" (first direction), the upper side on paper surface is an upper side, and the lower side on paper surface is a lower side. The left-right directions on paper surface of FIG. 1 is referred to as "front-back directions" (second direction, direction perpendicular to the first direction), and the right direction on paper surface is a front side, and the left direction on paper surface of FIG. 1 is a back side. The paper thickness direction in FIG. 1 is referred to as "width direction" (third direction, direction perpendicular to the first direction and the second direction), the front side in the paper thickness direction is one side in the width direction, and the further side in the paper thickness direction is the other side in the width direction. The directions in FIG. 4 are also based on the directions in FIG. 1.

The powder coating apparatus 1 is an apparatus for attaching powder 3 to a film 2, and includes a conveyance unit 4 and a spray unit 5.

The conveyance unit 4 includes an apparatus casing 6 as an example of the apparatus chamber, and a forward unit 7 and a taking unit 8 that are accommodated in the apparatus casing 6.

The apparatus casing 6 is formed into a box shape, and is hermetically sealable. The apparatus casing 6 accommodates a forward unit 7, a taking unit 8, a film-forming nozzle 18 (described later), and a stage 19 (described later).

The apparatus casing 6 includes a pressure gauge 51 for measuring the internal pressure of the apparatus casing 6 (to be specific, a space inside the apparatus casing 6, or a space excluding the space occupied by the first casing 9 (described later) and the second casing 13 (described later)).

The forward unit 7 is disposed at a lower and front side inside the apparatus casing 6.

The forward unit 7 includes a first casing 9 as an example of the roll chamber, a forwarding roll 10, a first tension roll 11*a*, and a second tension roll 11*b*.

Figure 3:
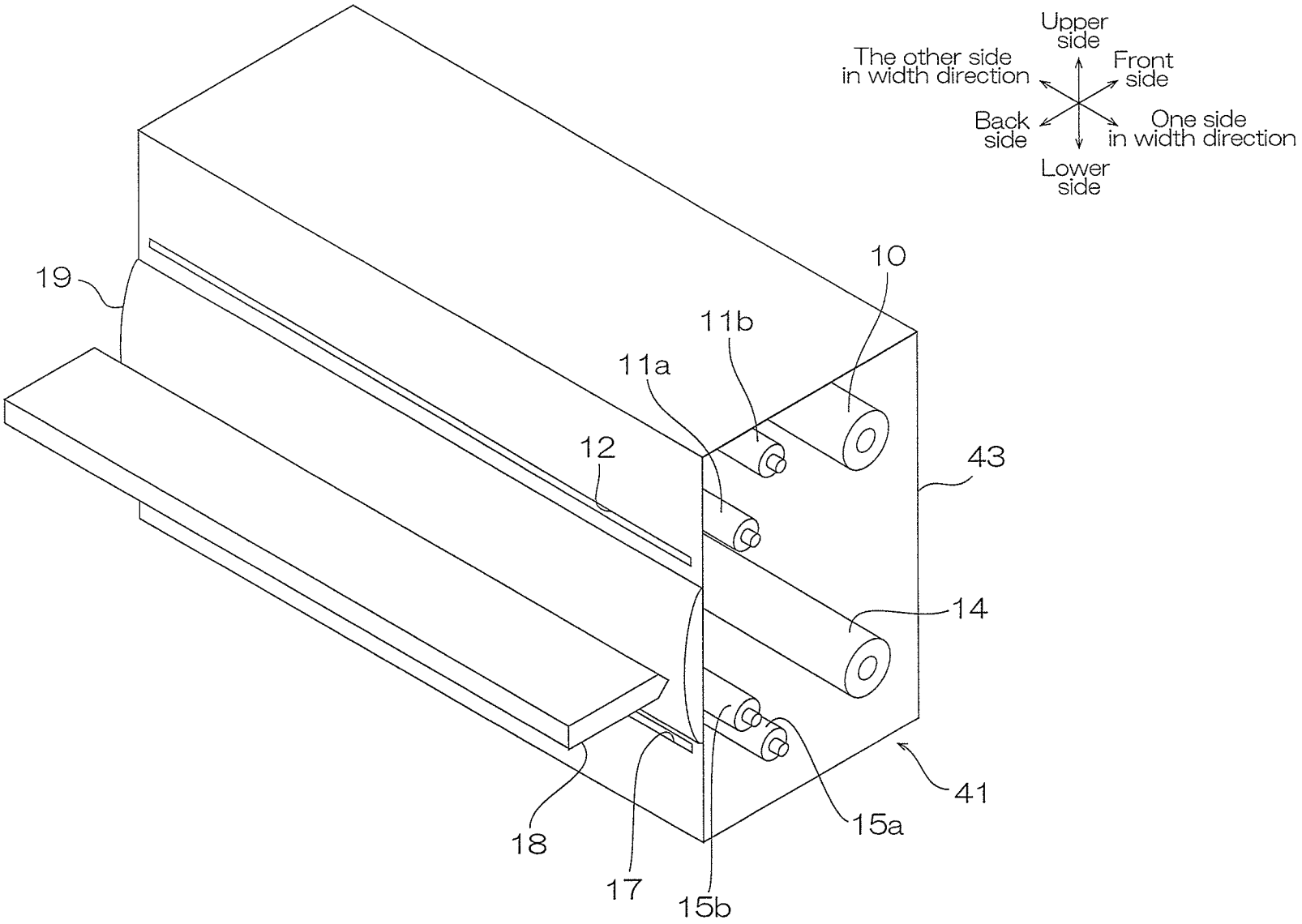
FIG. 3 shows a perspective view of a second casing and a film-forming nozzle of the powder coating apparatus of FIG. 2.

The first casing 9 is formed into a box shape and extends in the width direction (ref: FIG. 3), and accommodates the forwarding roll 10, the first tension roll 11*a*, and the second tension roll 11*b*. A forwarding opening 12 is formed on an upper side of the rear wall of the first casing 9. The forwarding opening 12 is formed into a slit extending in the width direction.

The first casing 9 includes a pressure gauge 52 for measuring the internal pressure of the first casing 9.

The forwarding roll 10 is a cylinder member having a rotational axis for forwarding the film 2, and is formed so as to extend in the width direction. The forwarding roll 10 is disposed at a lower end portion inside the first casing 9. The film 2 is wound around the surface of the forwarding roll 10 so that its reverse surface (the other side to the side to be coated) faces the roll surface. A gear (not shown) is provided at the end portion of the rotational axis of the forwarding roll 10, and a driving force is inputted from the motor (not shown) to the gear for rotating the forwarding roll 10 in the direction of the arrow.

The first tension roll 11*a* is a cylinder member having a rotational axis for keeping the tension of the film 2 forwarded by the forwarding roll 10 well, and is formed so as to extend in the width direction. The first tension roll 11*a* is disposed on an upper and back side of the forwarding roll 10.

The second tension roll 11*b* is a cylinder member having a rotational axis for keeping the tension of the film 2 conveyed from the first tension roll 11*a* well, and is formed so as to extend in the width direction. The second tension roll 11*b* is disposed at an upper side of the forwarding roll 10 and a front side of the first tension roll 11*a*.

A taking unit 8 is disposed at a lower end portion and a back side in the apparatus casing 6 so as to oppose the forward unit 7 in spaced-apart relation.

The taking unit 8 includes a second casing 13 as an example of the roll chamber, a take-up roll 14, a third tension roll 15*a*, and a fourth tension roll 15*b*.

The second casing 13 is formed into a box shape extending in the width direction (ref: FIG. 3), and accommodates the take-up roll 14, the third tension roll 15*a*, and the fourth tension roll 15*b*. A take-up opening 17 is formed on the upper side of the front wall of the second casing 13. The take-up opening 17 is formed into a slit extending in the width direction.

The second casing 13 includes a pressure gauge 53 for measuring the internal pressure of the second casing 13.

The take-up roll 14 is a cylinder member having a rotational axis for winding up the coated film 2, and is formed so as to extend in the width direction. The take-up roll 14 is disposed at a lower end portion in the second casing 13. The take-up roll 14 is disposed at a back side of the forwarding roll 10. That is, the take-up roll 14 is disposed at a downstream side of the forwarding roll 10 in the conveyance direction of the film 2 (hereinafter, simply referred to as "conveyance direction"). After the start operation of the powder coating apparatus 1, the coated film 2 is taken up on the surface of the take-up roll 14 so that the reverse surface thereof faces the roll surface. A gear (not shown) is provided at the end portion of a rotational axis of the take-up roll 14, and a driving force is inputted from the motor (not shown) to the gear for rotating the take-up roll 14 in the direction of the arrow.

The third tension roll 15*a* is a cylinder member having a rotational axis for keeping the tension of the coated film 2 forwarded from the take-up opening 17 well, and is formed so as to extend in the width direction. The third tension roll 15*a* is disposed at an upper side of the take-up roll 14.

The fourth tension roll 15*b* is a cylinder member having a rotational axis for keeping the tension of the coated film 2 conveyed from the third tension roll 15*a*, and is formed so as to extend in the width direction. The fourth tension roll 15*b* is disposed at an upper side of the take-up roll 14 and a front side of the third tension roll 15*a*.

The spray unit 5 includes a film-forming nozzle 18 as an example of the nozzle, a stage 19, a spray device 20, and a connection pipe 22.

The film-forming nozzle 18 is a spray device for jetting the powder 3 onto the surface of the film 2. The film-forming nozzle 18 is disposed at an upper side inside the apparatus casing 6 between the first casing 9 and the second casing 13 in the front-back directions so that the spray port faces a lower side (that is, stage 19). That is, the film-forming nozzle 18 is disposed so that the spray port faces the film 2 between the forwarding roll 10 and the take-up roll 14 in the conveyance direction inside the apparatus casing 6. In this manner, the film-forming nozzle 18 allows the powder 3 supplied from the spray device 20 to be sprayed onto the surface of the film 2 conveyed to the upper face of the stage 19.

The spray port of the film-forming nozzle 18 is formed so as to extend in the width direction, as shown in FIG. 3.

The stage 19 is formed into a generally rectangular shape extending in the width direction when viewed from the top, and formed into a bow shape (arc shape) projecting toward the upper side when viewed from a side, i.e., from one side in the width direction to the other side in the width direction. The stage 19 is disposed at a lower side to oppose the film-forming nozzle 18 in spaced-apart relation, and to oppose the first casing 9 and the second casing 13 in spaced-apart relation between the first casing 9 and the second casing 13 in the front-back directions. The highest projected portion (uppermost surface portion) 35 of the stage 19 is disposed so that the highest projected portion is positioned at a slightly upper side than the up-down direction position of the forwarding opening 12 and the take-up opening 17. The highest projected portion 35 of the stage 19 is the closest to the spray port of the film-forming nozzle 18. The distance between the highest projected portion 35 and the spray port of the film-forming nozzle 18 is, for example, 0.5 mm or more, preferably 1 mm or more, and for example, 100 mm or less, preferably 50 mm or less. In this manner, at the highest projected portion 35, the film 2 is coated with the powder 3 jetted from the film-forming nozzle 18.

The stage 19 is supported and fixed to the apparatus casing 6 through an X-Y-Z moving stage, which is not shown. By positioning the X-Y-Z moving stage automatically or manually, the position of the stage 19 can be adjusted with respect to the film-forming nozzle 18.

The spray device 20 stores the powder 3, and is a device that sends the powder 3 to the film-forming nozzle 18, and to be specific, examples include a device used for a known spray method.

Examples of the known spray method include aerosol jet methods such as aerosol deposition (AD method-gas deposition method (vapor deposition method)), cold spraying (high pressure cold spraying, low pressure cold spraying), and thermal spraying (plasma spraying, arc spraying, and frame spraying).

The connection pipe 22 is disposed so that its one end portion is connected to the spray device 20, and the other end portion is connected to the film-forming nozzle 18 penetrating through the upper wall of the apparatus casing 6.

The powder coating apparatus 1 includes a pressure adjustment unit 16. To be specific, the pressure adjustment unit 16 includes a gas introduction pipe 30 as an example of the gas forward unit, and the gas introduction pipe 30 includes a first gas introduction pipe 30*a* provided to the first casing 9, and a second gas introduction pipe 30*b* provided to the second casing 13.

The first gas introduction pipe 30*a* is disposed so that the one end portion (outlet side end portion) of the first gas introduction pipe 30*a* is positioned inside the first casing 9, and the other end portion (inlet side end portion) of the first gas introduction pipe 30*a* is positioned outside the apparatus casing 6 penetrating trough the front wall of the first casing 9 and the front wall of the apparatus casing 6. One end portion of the first gas introduction pipe 30*a* is disposed at a lower side to oppose the forwarding roll 10 inside the first casing 9.

To the other end portion of the first gas introduction pipe 30*a*, a pump (not shown) for sending outside air and compressed air inside the first casing 9 is connected.

The second gas introduction pipe 30*b* is disposed so that its one end portion (outlet side end portion) is positioned inside the second casing 13, and the other end portion (inlet side end portion) is positioned outside the apparatus casing 6 penetrating the rear wall of the apparatus casing 6 and the rear wall of the second casing 13. One end portion of the second gas introduction pipe 30*b* is disposed at a lower end to oppose the take-up roll 14 inside the second casing 13.

To the other end portion of the second gas introduction pipe 30*b* for sending outside air and compressed air to inside the second casing 13, a pump (not shown) is connected.

The powder coating apparatus 1 includes a cleaning nozzle 31 as an example of the powder removal unit, and an air jet nozzle 32.

A plurality (two) of the cleaning nozzles 31 are provided near the take-up opening 17 disposed between the film-forming nozzle 18 and the take-up roll 14 in front-back directions. That is, two cleaning nozzles 31 (31*a*, 31*b*) are provided on a downstream side of the film-forming nozzle 18 in the conveyance direction and an upstream side of the take-up roll 14 in the conveyance direction.

The cleaning nozzles 31 (31*a*, 31*b*) are supported and fixed to the second casing 13. The two cleaning nozzles 31 are disposed in spaced-apart relation to each other so that their spray ports are opposed with the take-up opening 17 (film 2) interposed therebetween. To be specific, one cleaning nozzle 31*a* is disposed at the upper side of the take-up opening 17 (film 2) in spaced-apart relation with the film 2 conveyed so that its spray port faces a lower side and a front side. The other cleaning nozzle 31*b* is disposed at the lower side of the take-up opening 17 (film 2) in spaced-apart relation with the film 2 conveyed so that its spray port faces an upper side and a front side.

One air jet nozzle 32 is provided near the forwarding opening 12 disposed between the forwarding roll 10 and the film-forming nozzle 18 in the front-back directions. That is, the air jet nozzle 32 is provided at a downstream side of the forwarding roll 10 in the conveyance direction and an upstream side of the film-forming nozzle 18 in the conveyance direction.

The air jet nozzle 32 is supported and fixed to the first casing 9. The air jet nozzle 32 is disposed to oppose the forwarding opening 12 (film 2). To be specific, the air jet nozzle 32 is disposed at a lower side of the forwarding opening 12 (film 2) so that its spray port faces the upper side and the back side in spaced-apart relation with the film 2 conveyed.

1-2. Coating Method

A method for coating the film 2 with the powder 3 using the powder coating apparatus 1 is described.

First, as shown in FIG. 1, the film 2 is set to the conveyance unit 4.

To be specific, the film 2 is wound around the forwarding roll 10 so that its reverse surface faces the surface of the forwarding roll 10. Then, the film 2 is forwarded to sequentially pass through a side face of a back side of the first tension roll 11*a*, a side face of a front side of the second tension roll 11*b*, and the forwarding opening 12. Thereafter, the film 2 is allowed to pass between the stage 19 and the film-forming nozzle 18 so as to contact the highest projected portion 35 of the stage 19. Then, the film 2 is allowed to pass through the take-up opening 17, a side face of a back side of the third tension roll 15*a*, and a side face of a front side of the fourth tension roll 15*b*, and is hooked on the take-up roll 14.

The film 2 is a film having a predetermined width elongated in the conveyance direction, and for example, a resin film and a metal foil can be used.

Examples of the resin film material include thermoplastic resin and thermosetting resin. Examples of the thermoplastic resin include olefin resin such as polyethylene and polypropylene, polyester resin such as PET, fluorine resin such as PTFE, polyamide resin such as nylon, polyimide resin, polyvinyl chloride cellulose fiber, and silicone fiber. Examples of the thermosetting resin include epoxy resin, phenol resin, amino resin, and unsaturated polyester resin.

Examples of the metal foil material include copper, iron, stainless steel, and aluminum.

The thickness of the film 2 is not limited, and for example, 5 μm or more, preferably 10 μm or more, and for example, 500 μm or less, preferably 100 μm or less.

Then, through the gas introduction pipe 30 (30*a*, 30*b*), gas is introduced to the first casing 9 and the second casing 13, so that the internal pressure of the first casing 9 and the second casing 13 is set higher than the internal pressure of the apparatus casing 6 (to be specific, the pressure in the space excluding the space occupied by the first casing 9 and the second casing 13).

The internal pressure of the apparatus casing 6 is, for example, 1 Pa or more, preferably 10 Pa or more, more preferably 50 Pa or more, and for example, 80000 Pa or less, preferably 10000 Pa or less, more preferably 1000 Pa or less.

The internal pressure of the first casing 9 and the second casing 13 is, for example, 10 Pa or more, preferably 50 Pa or more, more preferably 100 Pa or more, and for example, 80000 Pa or less, preferably 10000 Pa or less, more preferably 2100 Pa or less.

The difference between the internal pressure of the first casing 9 and the internal pressure of the apparatus casing 6 is, for example, 10 Pa or more, preferably 100 Pa or more, and for example, 10000 Pa or less, preferably 1000 Pa or less.

The difference between the internal pressure of the second casing 13 and the internal pressure of the apparatus casing 6 is, for example, 10 Pa or more, preferably 100 Pa or more, and for example, 10000 Pa or less, preferably 1000 Pa or less.

Then, by rotating the forwarding roll 10 and the take-up roll 14 in the direction of the arrow of the FIG. 1, the film 2 is conveyed.

To be specific, the film 2 is conveyed from the forwarding roll 10 to, in the sequence of, a side face of a back side of the first tension roll 11*a*, a side face of a front side of the second tension roll 11*b*, and the forwarding opening 12. Thereafter, the film 2 is conveyed from the forwarding opening 12, in the sequence of the highest projected portion 35 of the stage 19 and the take-up opening 17, that is, from the front side toward the back side. Thereafter, the film 2 is conveyed from the take-up opening 17, in the sequence of a side face of a back side of the third tension roll 15*a*, and a front face of a front side of the fourth tension roll 15*b*, and the take-up roll 14, and is taken up by the take-up roll 14.

The conveyance speed is, for example, 0.05 m/min or more, preferably 0.1 m/min or more, and for example, 100 m/min or less, preferably 50 m/min or less.

Meanwhile, the spray device 20 is filled with the powder 3 (material).

The powder 3 is not particularly limited, and for example, metal oxide powder, metal powder, and resin powder are used.

Examples of the metal oxide powder material include alumina, yttria, zirconia, and titania.

Examples of the metal material include copper, iron, stainless steel, and aluminum.

Examples of the resin material include thermoplastic resin and thermosetting resin. Examples of the thermoplastic resin include olefin resin such as polyethylene and polypropylene, polyester resin such as PET, fluorine resin such as PTFE, polyamide resin such as nylon, polyimide resin, polyvinyl chloride cellulose fiber, and silicone fiber. Examples of the thermosetting resin include epoxy resin, phenol resin, amino resin, and unsaturated polyester resin.

These can be used singly, or can be used in combination of two or more.

The powder has an average particle size (median size) of, for example, 0.05 μm or more and 10 μm or less. In particular, when aerosol deposition described later is used, it is preferably 0.1 μm or more, more preferably 0.5 μm or more, and preferably 10 μm or less, more preferably 2.5 μm or less. The average particle size (median size) is measured, for example, with a particle size distribution analyzer by dynamic light scattering method.

Then, from the film-forming nozzle 18 toward a lower side, that is, toward the film 2 conveyed, the powder 3 is sprayed by a known spray method (spray step).

In this manner, the powder 3 is attached to (coated) the film 2 forwarded from the forwarding roll 10 between the forwarding roll 10 and the take-up roll 14 in the conveyance direction. The film 2 to which the powder 3 is attached is taken up by the take-up roll 14 disposed at a downstream side in the conveyance direction.

In the spraying step, gas is discharged from the air jet nozzle 32 to the film 2 at the forwarding opening 12, and gas is discharged from the cleaning nozzle 31 (31*a*, 32*b*) to the film 2 at the take-up opening 17.

In this manner, gas from the air jet nozzle 32 collide with the reverse surface of the film 2 at the forwarding opening 12, and therefore attachment of the powder 3 to the reverse surface of the film 2 can be suppressed. As a result, the film deformation due to the reverse surface to which the powder 3 is attached contacting the stage 19 can be prevented.

Meanwhile, at the take-up opening 17, gas from the two cleaning nozzles 31 (31*a*, 32*b*) collide with the front and the reverse surfaces of the film 2 to which the powder 3 is attached, and therefore extra powder 3 attached to the film 2 is removed.

Then, the powder coating apparatus 1 includes a forwarding roll 10; a take-up roll 14 disposed at a back side (downstream side in conveyance direction) with respect to the forwarding roll 10; a film-forming nozzle 18 disposed between the forwarding roll 10 and the take-up roll 14 in the front-back directions (in conveyance direction) so as to oppose the film 2; a first casing 9 accommodating the forwarding roll 10; a second casing 13 accommodating a take-up roll 14; an apparatus casing 6 accommodating the film-forming nozzle 18, the first casing 9, and the second casing 13; and a pressure adjustment unit 16 that sets the internal pressure of the first casing 9 and the second casing 13 higher than the internal pressure of the apparatus casing 6.

Therefore, the powder 3 scattered inside the apparatus casing 6 having a relatively low pressure can be suppressed from entering inside the relatively high pressure first casing 9 and second casing 13. As a result, the powder 3 can be prevented from attaching to the first casing 9 and the second casing 13, the gear that drives the forwarding roll 10 and take-up roll 14, and the coated film 2. Therefore, the effects from the powder 3 can be reduced.

The powder coating apparatus 1 includes the first casing 9 and the second casing 13, and the first casing 9 accommodates the forwarding roll 10, and the second casing 13 accommodates the take-up roll 14.

Therefore, relative position and distance between the forwarding roll 10 and the take-up roll 14 can be adjusted freely. As a result, the apparatus can be designed freely.

In the powder coating apparatus 1, the gas introduction pipe 30 is used to introduce gas outside from the apparatus casing 6 to inside the first casing 9 and second casing 13 to adjust the internal pressure of the first casing 9 and second casing 13.

Therefore, the internal pressure of the first casing 9 and the second casing 13 can be set higher than the internal pressure of the apparatus casing 6 simply and reliably.

1-3. Modified Example

In the embodiment of FIG. 1, two cleaning nozzles 31 are included near the take-up opening 17, but for example, although not shown, one cleaning nozzle 31 can be included, or the cleaning nozzle 31 does not have to be included.

Preferably, the powder coating apparatus 1 includes two cleaning nozzles 31. In this manner, extra powder 3 attached to the film 2 can be reliably removed, and a level of quality of the coated film 2 can be kept. From the film 2 taken up by the take-up roll 14, the extra powder 3 is automatically removed by the cleaning nozzle 31, and therefore the step for removing the powder 3 from the film 2 when used thereafter is unnecessary.

In the embodiment of FIG. 1, the air jet nozzle 32 is included near the forwarding opening 12, but for example, although not shown, the air jet nozzle 32 does not have to be included.

Preferably, the powder coating apparatus 1 includes the air jet nozzle 32. In this manner, attachment of the reverse surface of the powder 3 to the film 2 can be suppressed. Therefore, film deformation from the reverse surface to which the powder 3 is attached contacting the stage 19 can be prevented.

In the embodiment of FIG. 1, by introducing gas to the first casing 9 and to the second casing 13 through the gas introduction pipe 30 (30*a*, 30*b*), the internal pressure of the first casing 9 and the second casing 13 is set higher than the internal pressure of the apparatus casing 6; however, for example, although not shown, the internal pressure of the apparatus casing 6 can be set low by setting a vacuum pump to the apparatus casing 6 and opening the first casing 9 and the second casing 13 into the air through the gas introduction pipe 30 (30*a*, 30*b*) so that the internal pressure of the first casing 9 and the second casing 13 can be set higher than the internal pressure of the apparatus casing 6.

In the embodiment of FIG. 1, the powder 3 is attached only to the surface of the film 2, but for example, although not shown, the powder 3 can be attached to the both sides (surface and reverse surface) of the film 2. To be specific, after the powder 3 is attached to the surface of the film 2, and after the film 2 is completely taken up by the take-up roll 14, the roll 14 to which the film 2 is taken and the forwarding roll 10 are removed, exchanged, and then attached. Then, the film 2 is conveyed from the take-up roll 14 to the forwarding roll 10 so that the powder 3 is attached to the reverse surface of the film 2 at the highest projected portion 35 of the stage 19.

Although not shown, by suitably adjusting the shape and the position of the stage 19, and by further disposing the film-forming nozzle on a lower side of the stage 19, the powder 3 can be attached simultaneously to both sides of the film 2.

In the embodiments of FIG. 1 and FIG. 3, one film-forming nozzle 18 having the spray hole shaped so as to extend in the width direction is included, but for example, although not shown, the film-forming nozzle 18 can include a plurality of film-forming nozzles arranged in line in the width direction.

In the embodiment of FIG. 1, four tension rolls (11*a*, 11*b*, 15*a*, 15*b*) are included, but for example, although not shown, the number of the tension roll can be suitably reduced or increased.

2. Second Embodiment

A second embodiment of the powder coating apparatus of the present invention is described with reference to FIG. 2.

Figure 2:
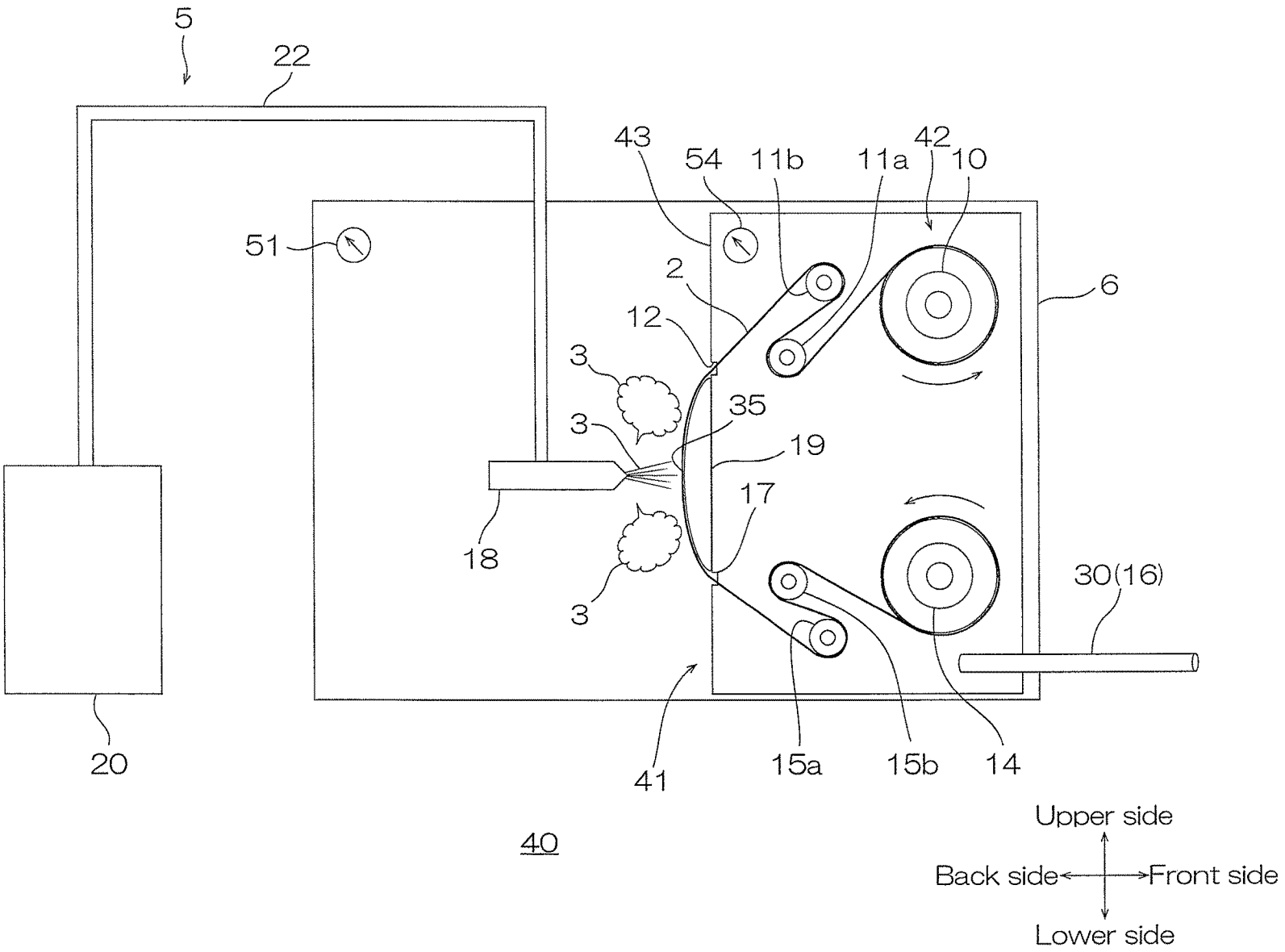
FIG. 2 shows a diagram illustrating the configuration of a second embodiment of the powder coating apparatus of the present invention.

In description for FIG. 2, those members that are the same as those in the embodiment of FIG. 1 are given the same reference numerals, and descriptions thereof are omitted.

When referring to the direction of the powder coating apparatus, the up-down directions on paper surface of FIG. 2 are referred to as "up-down directions" (first direction), the upper side on paper surface is the upper side, and the lower side on paper surface is the lower side. The left-right directions on paper surface of FIG. 2 are referred to as "front-back directions" (second direction, direction perpendicular to the first direction), the right direction on paper surface is the front side, and the left direction on the paper surface of FIG. 2 is the back side. The paper thickness direction of FIG. 2 is referred to as "width direction" (third direction, direction perpendicular to the first direction and the second direction), the front side in the paper thickness direction is one side in the width direction, and the further side in the paper thickness direction is the other side in the width direction. FIG. 3 is also based on the directions of FIG. 2.

The powder coating apparatus 40 of the second embodiment includes a conveyance unit 41 and a spray unit 5.

The conveyance unit 41 includes an apparatus casing 6 and a forwarding/taking unit 42 accommodated in the apparatus casing 6.

The forwarding/taking unit 42 is disposed at a front side of the apparatus casing 6.

The forwarding/taking unit 42 includes a roll casing 43 as an example of the roll chamber, a forwarding roll 10, a take-up roll 14, a first tension roll 11*a*, a second tension roll 11*b*, a third tension roll 15*a*, and a fourth tension roll 15*b*.

The roll casing 43 is formed into a box shape (ref: FIG. 3) extending in the width direction, and accommodates the forwarding roll 10, the take-up roll 14, the first tension roll

11*a*, the second tension roll 11*b*, the third tension roll 15*a*, and the fourth tension roll 15*b*.

A forwarding opening 12 and a take-up opening 17 are formed on the rear wall of the roll casing 43. The forwarding opening 12 is formed so as to extend in the width direction at an upper side of the rear wall of the roll casing 43. The take-up opening 17 is formed so as to extend in the width direction at a lower side of the rear wall in spaced-apart relation with the forwarding opening 12.

The forwarding roll 10 is disposed at an upper side and a front side of the roll casing 43.

The take-up roll 14 is disposed at a lower side and a front side of the roll casing 43. That is, the take-up roll 14 is disposed at a lower side of the forwarding roll 10 so as to oppose the forwarding roll 10.

The first tension roll 11*a* is disposed at a back side of the forwarding roll 10.

The second tension roll 11*b* is disposed at a back side of the forwarding roll 10 and an upper side of the first tension roll 11*a*.

The third tension roll 15*a* is disposed at a back side of the take-up roll 14.

The fourth tension roll 15*b* is disposed at a back side of the take-up roll 14 and an upper side of the third tension roll 15*a*.

The roll casing 43 includes a pressure gauge 54 for measuring the internal pressure of the roll casing 43.

The spray unit 5 includes a film-forming nozzle 18, a stage 19, a spray device 20, and a connection pipe 22.

The film-forming nozzle 18 is disposed at a back side with respect to the rear wall of the roll casing 43 in spaced-apart relation. The film-forming nozzle 18 is positioned so as to be between the forwarding opening 12 and the take-up opening 17 in up-down direction. The spray port of the film-forming nozzle 18 is disposed so as to face the front side of the stage 19.

The stage 19 is formed into a generally rectangular shape extending in the width direction when viewed from the front, and formed into a bow shape (arc shape) protruding toward the back side when viewed from a side, i.e., from one side to the other side in the width direction. The stage 19 is disposed at a front side to oppose the film-forming nozzle 18 in spaced-apart relation. The stage 19 is disposed so that its front side is in contact with the rear wall of the roll casing 43. To be specific, the stage 19 is disposed between the forwarding opening 12 and the take-up opening 17 in the up-down direction. The highest projected portion 35 of the stage 19 is the closest to the spray port of the film-forming nozzle 18, and at the highest projected portion 35, the film 2 is coated with the powder 3 jetted from the film-forming nozzle 18.

The stage 19 is supported and fixed to the roll casing 43.

The powder coating apparatus 40 includes a pressure adjustment unit 16 having a gas introduction pipe 30. The gas introduction pipe 30 is provided on the roll casing 43.

The gas introduction pipe 30 is disposed so that its one end portion (outlet side end portion) is positioned inside the roll casing 43 and the other end portion (inlet side end portion) is positioned outside the apparatus casing 6 penetrating the front wall of the apparatus casing 6 and the roll casing 43. One end portion of the gas introduction pipe 30 is disposed at a position lower than the take-up roll 14 inside the roll casing 43.

For the coating method by which the powder 3 is attached to the film 2 using the powder coating apparatus 40 of the second embodiment, it can be performed in the same manner as in the powder coating apparatus 1 of the first embodiment.

That is, as shown in FIG. 2, the film 2 is set to the forwarding/taking unit 42. That is, in the same manner as in the first embodiment, the film 2 is wound around the forwarding roll 10, passed through the first tension roll 11*a*, the second tension roll 11*b*, the forwarding opening 12, the highest projected portion 35 of the stage 19, the third tension roll 15*a*, the fourth tension roll 15*b*, and the take-up opening 17 sequentially, and hooked on the take-up roll 14.

Then, by introducing gas to the roll casing 43 through the gas introduction pipe 30, the internal pressure of the roll casing 43 is set higher than the internal pressure of the apparatus casing 6 (to be specific, pressure of the space excluding the space occupied by the roll casing 43).

The internal pressure of the roll casing 43 is, for example, 10 Pa or more, preferably 50 Pa or more, more preferably 100 Pa or more, and for example, 80000 Pa or less, preferably 10000 Pa or less, more preferably 2100 Pa or less.

The difference between the internal pressure of the roll casing 43 and the internal pressure of the apparatus casing 6 is, for example, 10 Pa or more, preferably 100 Pa or more, and for example, 10000 Pa or less, preferably 1000 Pa or less.

Meanwhile, after the spray device 20 is charged with the powder 3, from the film-forming nozzle 18 to the front side, that is, toward the film 2 conveyed, spraying is performed by a known spray method.

The film 2 having the powder 3 attached on (coating) the surface is produced in this manner.

Then, the powder coating apparatus 40 includes a forwarding roll 10; a take-up roll 14 disposed at a lower side (lower side in conveyance direction) with respect to the forwarding roll 10; a film-forming nozzle 18 disposed between the forwarding roll 10 and the take-up roll 14 in the up-down direction (in conveyance direction) so as to oppose the film 2; a roll casing 43 for accommodating the forwarding roll 10 and the take-up roll 14; an apparatus casing 6 accommodating the film-forming nozzle 18 and the roll casing 43; and a pressure adjustment unit 16 that sets the internal pressure of the roll casing 43 higher than the internal pressure of the apparatus casing 6.

Therefore, the powder 3 scattered inside the apparatus casing 6 having a relatively low pressure can be suppressed from entering inside the roll casing 43 having a relatively high pressure. As a result, the powder 3 can be prevented from being attached to the forwarding roll 10 and the take-up roll 14, the gear driving the forwarding roll 10 and the take-up roll 14, and the coated film 2. Therefore, the effects from the powder 3 can be reduced.

The powder coating apparatus 40 includes the roll casing 43, and the roll casing 43 accommodates the forwarding roll 10 and the take-up roll 14.

Therefore, only the internal pressure of the roll casing 43 should be set higher than the internal pressure of the apparatus casing 6, and therefore the apparatus can be made simple.

In the powder coating apparatus 40, gas is introduced from outside the apparatus casing 6 to inside the roll casing 43 using the gas introduction pipe 30 to adjust the internal pressure of the roll casing 43.

Therefore, the internal pressure of the roll casing 43 can be set higher than the internal pressure of the apparatus casing 6 easily and reliably.

The cleaning nozzle 31 is not included in the embodiment of FIG. 2; however, for example, as shown in FIG. 1, one, or two or more cleaning nozzles 31 can be included near the take-up opening 17.

The air jet nozzle 32 is not included in the embodiment of FIG. 2; however, for example, as shown in FIG. 1, the air jet nozzle 32 can be included near the forwarding opening 12.

In the embodiment of FIG. 2, by introducing gas to the roll casing 43 through the gas introduction pipe 30, the internal pressure of the roll casing 43 is set higher than the internal pressure of the apparatus casing 6; however, for example, although not shown, the internal pressure of the roll casing 43 can be set higher than the internal pressure of the apparatus casing 6 by setting a vacuum pump to the apparatus casing 6, and opening the roll casing 43 into the air through the gas introduction pipe 30 so that the internal pressure of the roll casing 43 can be set higher than the internal pressure of the apparatus casing 6.

In the embodiment of FIG. 2, the powder 3 is attached to only the surface of the film 2, but for example, although not shown, the powder 3 can be attached to both sides (surface and reverse surface) of the film 2. To be specific, the powder 3 is attached to the surface of the film 2, and after the film 2 is completely taken up by the take-up roll 14, the take-up roll 14 to which the film 2 is taken and the forwarding roll 10 are removed, exchanged, and then attached. Then, the film 2 is conveyed from the take-up roll 14 to the forwarding roll 10 so that the powder 3 is attached to the reverse surface of the film 2 at the highest projected portion 35 of the stage 19.

Although not shown, by suitably adjusting the shape and the position of the stage 19, and by further disposing the film-forming nozzle on a front side of the stage 19, the powder 3 can be attached simultaneously to both sides of the film 2.

In the embodiments of FIG. 2 and FIG. 3, one film-forming nozzle 18 having the spray hole shaped so as to extend in the width direction is included, but for example, although not shown, the film-forming nozzle 18 can include a plurality of film-forming nozzles arranged in line in the width direction.

In the embodiment of FIG. 2, four tension rolls (11*a*, 11*b*, 15*a*, 15*b*) are included, but for example, although not shown, the number of the tension roll can be suitably reduced or increased.

3. Powder Coating Apparatus by Aerosol Deposition

One embodiment of the present invention of the powder coating apparatus 50 using aerosol deposition is described using FIG. 4 as a further specific example of the first embodiment.

The powder coating apparatus 50 of FIG. 4 includes an aerosol chamber 21 and a carrier gas transportation device 24 as a spray device 20.

The aerosol chamber 21 is a storage that stores the powder 3, and includes a vibratory device 29, and a pressure gauge (not shown) for measuring the internal pressure of the aerosol chamber 21.

The vibratory device 29 is a device for vibrating the aerosol chamber 21 and the powder 3 in the aerosol chamber 21, and a known shaker is used.

To the aerosol chamber 21, the connection pipe 22 is connected.

The connection pipe 22 is a pipe for transporting the aerosolized powder 3 (hereinafter aerosol) from the aerosol chamber 21 to the apparatus casing 6, and its one end portion is connected to the aerosol chamber 21, and the other end portion is connected to the film-forming nozzle 18.

A connection pipe on-off valve 23 is interposed in the connection pipe 22. Examples of the connection pipe on-off valve 23 include a known on-off valve such as a solenoid valve.

The carrier gas transportation device 24 includes a carrier gas cylinder 25 and a gas pipe 26.

The carrier gas cylinder 25 is a cylinder in which a carrier gas such as oxygen gas, helium gas, argon gas, nitrogen gas, and air is stored, and is connected to the aerosol chamber 21 through the gas pipe 26.

The gas pipe 26 is a pipe for transporting the carrier gas from the carrier gas cylinder 25 to the aerosol chamber 21, and its one end portion is connected to the carrier gas cylinder 25, and the other end portion is connected to the aerosol chamber 21.

A gas flow meter 27 is interposed in the gas pipe 26. The gas flow meter 27 is a device that adjusts and detects the gas flow rate in the gas pipe 26, and a known flow meter is used.

Furthermore, in the gas pipe 26, a gas pipe on-off valve 28 is interposed at a side closer to the aerosol chamber 21 than the gas flow meter 27. For the gas pipe on-off valve 28, for example, a known on-off valve such as a solenoid valve is used.

In the powder coating apparatus 50, the mechanical booster pump 33 and the rotary pump 34 are provided to the apparatus casing 6.

The mechanical booster pump 33 and the rotary pump 34 are connected to the apparatus casing 6 in sequence, to decrease the pressure inside the apparatus casing 6, and decrease the pressure inside the aerosol chamber 21 communicating the apparatus casing 6 through the connection pipe 22.

To attach powder 3 to the film 2 with the powder coating apparatus 50, as described above, the film 2 is set to the conveyance unit 4, and then the internal pressure of the first casing 9 and the second casing 13 is set higher than the internal pressure of the apparatus casing 6 with the gas introduction pipe 30 to convey the film 2.

Then, in the coating method of the powder coating apparatus 50, the spraying step performs the following procedure.

First, in this step, the gas pipe on-off valve 28 is closed, and the connection pipe on-off valve 23 is opened to drive the mechanical booster pump 33 and the rotary pump 34, thereby decreasing the pressure inside the apparatus casing 6 and the aerosol chamber 21.

The internal pressure of the apparatus casing 6 is, for example, 5 to 80 Pa, and the internal pressure of the aerosol chamber 21 is, for example, 5 to 80 Pa.

Next, in this method, the powder 3 is vibrated by the vibratory device 29 in the aerosol chamber 21, and the connection pipe on-off valve 23 is closed and the gas pipe on-off valve 28 is opened, thereby feeding the carrier gas from the carrier gas cylinder 25 to the aerosol chamber 21. The powder 3 is aerosolized in this manner. Thereafter, the connection pipe on-off valve 23 is opened, and the generated aerosol is transported to the film-forming nozzle 18 through the connection pipe 22. At this time, the aerosol collides with the internal wall of the film-forming nozzle 18 and is broken, to be particles having a further smaller particle size.

The flow rate of the carrier gas adjusted by the gas flow meter 27 is, for example, 1 L/min or more, preferably 3 L/min or more, and for example, 150 L/min or less, preferably 100 L/min or less.

Next, in this method, aerosol is sprayed from the spray port of the film-forming nozzle 18 toward the surface of the film 2.

The internal pressure of the aerosol chamber 21 during aerosol spraying is, for example, 50 Pa or more, preferably 1000 Pa or more, and for example, 1 atm or less, preferably 50000 Pa or less.

At this time, by feeding gas by the gas introduction pipe 30, the internal pressure of the first casing 9 and the second casing 13 are set, as described above, higher than the internal pressure of the apparatus casing 6.

For example, the difference between the internal pressure of the apparatus casing 6 and the internal pressure of the first casing 9 or the second casing 13 is, for example, 10 Pa or more, preferably 100 Pa or more, and for example, 10000 Pa or less, preferably 1000 Pa or less.

The temperature inside the aerosol chamber 21 of the spraying the aerosol is, for example, 0 to 50° C.

The powder 3 is attached to the surface of the film 2 in this manner.

The powder coating apparatus 50 allows coating of the powder 3 by aerosol deposition, and therefore a fine powder layer or a porous powder layer can be formed on the surface of the film 2. Particularly, when metal oxide particles are used as the powder 3, a fine metal oxide layer or a porous metal oxide layer can be easily formed.

The powder coating apparatus 50 uses roll to roll method, and therefore compared with a conventional batch, the powder layer can produce the coated film 2 with significant efficiency.

The powder coating apparatus 50 can set the internal pressure of the first casing 9 and the second casing 13 higher than the internal pressure of the apparatus casing 6, and therefore the powder 3 can be prevented from being attached to the forwarding roll 10, the take-up roll 14, the gear driving the take-up roll 14 or the forwarding roll 10, and the coated film 2. Therefore, the effects from the powder 3 can be reduced.

Although the description above was provided to give an example of the embodiment of the present invention, such are for illustrative purpose only and it is not to be construed limitatively. Modification and variation of the present invention which will be obvious to those skilled in the art are to be covered in the following claims.

INDUSTRIAL APPLICABILITY

The powder coating apparatus of the present invention is suitably used as, for example, a powder coating apparatus for attaching powder to a film.

DESCRIPTION OF REFERENCE NUMERAL

1 Powder coating apparatus
2 Film
3 Powder
6 Apparatus casing
9 First casing
10 Forwarding roll
13 Second casing
14 Take-up roll
16 Pressure adjustment unit
18 Film-forming nozzle
30 Gas introduction pipe
32 Cleaning nozzle
40 Powder coating apparatus
43 Roll casing
50 Powder coating apparatus

The invention claimed is:

1. A powder coating apparatus for attaching powder to a film, comprising:

a forwarding roll which forwards the film;

a take-up roll which is arranged on the downstream side of a conveyance direction of the film with respect to the forwarding roll and which takes up the film;

a nozzle which is arranged between the forwarding roll and the take-up roll in the conveyance direction so as to be opposed to the film and which jets the powder;

at least one roll chamber which accommodates the forwarding roll and the take-up roll;

an apparatus chamber which accommodates the nozzle and the at least one roll chamber;

a pressure adjustment unit configured to set an internal pressure of the at least one roll chamber to be higher than an internal pressure of the apparatus chamber;

a powder removal device which is arranged between the downstream side of the nozzle and the upstream side of the take-up roll in the conveyance direction so as to be opposed to the film and which removes an excess of powder; and an air jet nozzle which is arranged between the upstream side of the nozzle in the conveyance direction and the downstream side of the forwarding roll in the conveyance direction so as to oppose the film, and suppresses powder attachment to the film, wherein the powder removal device is a cleaning nozzle which discharges a gas, and a difference between an internal pressure of the at least one roll chamber and an internal pressure of the apparatus chamber is 100 Pa or more.

2. The powder coating apparatus according to claim 1, comprising two roll chambers, wherein one roll chamber accommodates the forwarding roll and the other roll chamber accommodates the take-up roll.

3. The powder coating apparatus according to claim 1, comprising one roll chamber, wherein the one roll chamber accommodates the forwarding roll and the take-up roll.

4. The powder coating apparatus according to claim 1, wherein the pressure adjustment unit comprises a gas feeding device which feeds gas into the at least one roll chamber.

* * * * *